US005310493A

United States Patent [19]

Olson et al.

[11] Patent Number: 5,310,493

[45] Date of Patent: May 10, 1994

[54] STABILIZED BRAKE FLUIDS CONTAINING METAL BOROHYDRIDE AND BUTYLATED HYDROXYTOLUENES

[75] Inventors: Charles M. Olson, Midland; Bart R. Burza, Sanford, both of Mich.

[73] Assignee: The Dow Chemical Company, Midland, Mich.

[21] Appl. No.: 947,376

[22] Filed: Sep. 18, 1992

Related U.S. Application Data

[63] Continuation of Ser. No. 699,826, May 14, 1991, abandoned.

[51] Int. Cl.[5] ..... C10M 125/08; C10M 129/04

[52] U.S. Cl. ..... 252/74; 252/49.6; 252/52 A; 252/75

[58] Field of Search ..... 252/74, 75, 49.6, 52 R, 252/52 A, 400.4

[56] References Cited

U.S. PATENT DOCUMENTS

| | | | |
|---|---|---|---|
| 2,942,033 | 6/1960 | Leis et al. | 568/581 |
| 3,329,614 | 7/1967 | Milnes et al. | 252/75 |
| 3,374,275 | 3/1968 | Dickey | 568/582 |
| 4,070,304 | 1/1978 | Hinze | 252/404 |
| 4,265,783 | 5/1991 | Hinze | 252/182.27 |
| 4,275,173 | 6/1981 | Hinze | 521/117 |
| 4,371,448 | 2/1983 | Knoblauch et al. | 252/78.1 |
| 4,528,109 | 7/1985 | Fifolt et al. | 252/78.1 |
| 4,592,851 | 6/1986 | Stadtmiller et al. | 252/32.7 E |
| 4,596,664 | 6/1986 | Fifolt et al. | 252/75 |
| 4,692,258 | 9/1987 | Rasberger et al. | 252/50 |
| 4,701,273 | 10/1987 | Brady et al. | 252/32.5 |
| 4,783,274 | 11/1988 | Jokinen et al. | 252/32.7 E |

FOREIGN PATENT DOCUMENTS 0175546 3/1986 European Pat. Off. .

*Primary Examiner*—Christine Skane
*Attorney, Agent, or Firm*—Robert M. O'Keefe

[57] ABSTRACT

In a composition having one or more glycol-based diluents, one or more lubricants, and one or more inhibitors, the improvement comprising: (A) 0.001 to 1.0 percent by weight of one or more butylated hydroxytoluenes, and (B) 0.001 to 1.0 percent by weight of one or more metal borohydrides.

22 Claims, No Drawings

STABILIZED BRAKE FLUIDS CONTAINING METAL BOROHYDRIDE AND BUTYLATED HYDROXYTOLUENES

This application is a continuation of U.S. patent application Ser. No. 07/699,826, filed May 14, 1991, now abandoned.

BACKGROUND OF THE INVENTION

This invention relates to certain additives in hydraulic fluids which provide improved stabilization of the fluids.

Hydraulic fluids are well known and useful in various mechanical apparatus such as in automotive brakes. They may be clear to amber or even light brown in color. Since hydraulic fluids are highly prone to oxidation, especially at high temperatures, it is known to add various antioxidants to the fluids. Oxidation is undesirable because it eventually reduces the molecular weight of the fluids and produces corrosive products. Buffers are added to control the effects of the corrosive, oxidation products.

Certain problems continue to exist, however. Even today, hydraulic fluids are stabilized insufficiently while stored for sale. Many of the additives currently employed are effective for only a few days, in some cases only a few hours. The lack of stabilization is evidenced by the collapse of plastic bottles used to store the fluids. Presumably, this effect is due to the partial vacuum created as oxygen in the head space of the bottles reacts with the fluids.

Therefore, since stabilization continues to be a problem in modern hydraulic fluids, it would be desirable to find a combination of additives which provide improved stabilizing effect over those used currently and which provide long-term protection on the order of months, not days or hours. Such a combination would improve the quality of hydraulic fluids as well as the commercial appeal of the hydraulic fluids due to the plastic storage bottles retaining their shape rather than collapsing while in storage.

A solution to this problem is one object of the present invention.

SUMMARY OF THE INVENTION

It has now been found that the addition of a combination of one or more metal borohydrides and one or more butylated hydroxytoluenes provides superior stabilizing effect in hydraulic fluids. Surprisingly, the combination is found to possess synergism as the stabilizing effect is superior to that either of metal borohydride alone or of butylated hydroxytoluene alone, or the effect one would expect from the combination. The hydraulic fluid composition of this invention exhibits improved stabilizing effect and, hence, protects fluids stored in plastic bottles from collapsing during storage. Thus, the combination of stabilizers of the present invention improve the commercial appeal of the hydraulic fluids. Moreover, the stabilizing combination of the present invention provides protection for months, typically at least two months.

In one respect, the present invention is in a composition having one or more glycol-based diluents, one or more lubricants, and one or more inhibitors, the improvement comprising: (A) 0.001 to 1.0 percent by weight of one or more butylated hydroxytoluenes, and (B) 0.001 to 1.0 percent by weight of one or more metal borohydrides.

DETAILED DESCRIPTION OF ILLUSTRATIVE EMBODIMENTS

The hydraulic fluids of this invention generally comprise a diluent portion, a lubricant portion, one or more inhibitors such as antioxidants, one or more corrosion inhibitors, and one or more alkaline pH buffers. The color of the compositions may be clear to amber or even light brown in color depending on the particular combination of components. In some cases, the diluent and lubricant may be the same. The hydraulic fluids also comprise a combination of one or more butylated hydroxytoluenes and one or more metal borohydrides. The combination stabilizes the hydraulic fluids better than either butylated hydroxytoluene alone or metal borohydride alone.

The diluents useful in the present invention may comprise one or more alcohols, glycols, glycol ethers, or mixtures thereof. Diluents useful in the present invention typically have an average molecular weight below about 300. Preferably, the diluent may comprise a monohydric alcohol or dihydric alcohol, a glycol monoether or glycol diether, and mixtures thereof. Thus, useful diluents may be of the formula:

$$HO(RO)_xH$$

wherein R is a diradical alkylene group of from about 2 to 4 carbon atoms and x is an integer of from about 1 to 4. Glycol monoethers and glycol diethers may be of the formula:

$$R^2[O\text{-}R]_yOR^3$$

wherein R is as defined above, $R^2$ is hydrogen or an alkyl group of from 1 to about 6 carbon atoms, $R^3$ is hydrogen or an alkyl group of from about 1 to 6 carbons, and y is an integer of from 1 to 6. Non-limiting examples of useful glycol ethers include ethylene glycol monomethyl ether, diethylene glycol monomethyl ether, triethylene glycol monomethyl ether, propylene glycol monomethyl ether, dipropylene glycol monomethyl ether, tripropylene glycol monomethyl ether, diethylene glycol monobutyl ether, triethylene glycol monobutyl ether, tetraethylene glycol monobutyl ether, tetrapropylene glycol monobutyl ether.

The lubricants of the present invention comprise heavy bodied fluids such as polyglycols, castor oil, or mixtures of these materials. Ordinarily, lubricants useful in the present invention have an average molecular weight above about 350, preferably ranging from about 400 to 500. The lubricant may comprise one or more polyhydric alcohols or polyhydric alcohol ethers, or mixtures thereof. Non-limiting examples of polyhdric alcohols are polyoxyalkylene glycols such as polyoxyethylene glycols and polyoxypropylene glycols; mixed polyoxyalkylene glycols such as polyoxyethylene-polyoxypropylene glycols. Non-limiting examples of polyhydric alcohols include polyoxyethylene glycol nonylphenyl ethers, polyoxypropylene glycol mono- and di-alkyl ethers; mixed polyoxyethylene and polyoxypropylene monoalkyl and dialkyl ethers, and mixtures thereof.

The inhibitors useful in the present invention generally comprise oxidation inhibitors, corrosion inhibitors, and alkaline buffers. Useful alkaline buffers are well known in the art and are used to maintain the pH of the hydraulic fluids between about 7 and 11.5. Non-limiting examples of alkaline buffers comprise metal borates such as sodium borate and potassium borate; alkali metal soaps of fatty acids such as potassium oleate, the potassium soap of rosin, or tall oil fatty acids; alkylene glycol condensates with alkali metal borates such as the ethylene glycol condensates of potassium tetraborate; amines such as morpholine, phenyl morpholine, ethanolamine, diethanolamine, triethanolamine, methyl diethanolamine, di-(2-ethylhexyl)amine, di-N-butyl amine, monoamyl amine, diamyl amine, dioctyl amine, salicyl monoethanolamine, di-beta-naphthyl-p-phenylene diamine, dicyclohexyl amine; amine salts such mono- or di-butyl ammonium borates; and dibutyl amine phosphates.

Various oxidation inhibitors and corrosion inhibitors, well known in the art, may be employed in the compositions to protect the fluid and primarily the diluents from oxidative degradation and corrosion of metals such as copper, cast iron, tinned iron, brass, aluminum, and steel. Non-limiting examples of these are polymerized trimethyl dihyroquinoline; aryl and alkyl disubstituted amines and diamines; condensates of amines and diamines; condensates of aryl and alkyl monosubstituted and disubstituted amines and diamines; anthraquinone; dihydroxy anthraquinone; alkylated quinones; phenyl benzoate; pyrocatechol; styrenated phenol; sodium nitrite; sodium nitrate; and 4,4'-isopropylidenediphenol.

Generally, the composition of the present invention may comprise widely varying proportions of the individual components. The diluent may comprise between from about 50 to 90 percent by volume of the composition, preferably between from about 75 to 90 percent by volume. The lubricant may comprise from about 5 to 50 percent by volume of the composition, preferably from about 5 to 25 percent by volume. The diluent and lubricant together may comprise up to about 99.5 percent by volume of the composition, preferably comprise up to about 95 percent by volume of the composition. The total concentration of inhibitors may comprise from about 0.1 to 5 percent by weight of the composition with one or more alkaline buffers comprising from about 0.01 to 4.0 percent by weight of the composition, one or more oxidation inhibitors comprising from about 0.01 to 4.0 percent by weight, and one or more corrosion inhibitors comprising from about 0.01 to 4.0 percent by weight.

The metal borohydrides useful in the present invention comprise alkali metal borohydrides such as sodium and potassium borohydride and alkaline earth metal borohydrides such as lithium borohydride. Preferred borohydrides are the alkali metal borohydrides. In a more preferred embodiment, the metal borohydrides is sodium borohydride. The amount of metal borohydride used in the present invention is in the range from about 0.001 to about 1.0 percent by weight, preferably from about 0.001 to about 0.1 percent by weight.

The butylated hydroxytoluenes useful in this invention comprise monobutylated, dibutylated, and tributylated hydroxytoluenes with dibutylated being preferred. The butyl groups may be n-butyl, sec-butyl, isobutyl, tert-butyl, or combinations thereof. Preferably, the butyl groups are tert-butyl groups. Examples of useful butylated hydroxytoluenes include, but are not limited to, 2,6-di-tert-butyl-para-hydroxytoluene. Most preferably, the butylated hydroxytoluene is 2,6-diterbutyl-para-hydroxytoluene. The amount of butylated hydroxytoluene may comprise from about 0.001 to about 1.0 percent by weight of the composition, preferably from about 0.01 to about 1.0 percent by weight.

Other well-known additives such as antifoam agents and rubber swelling additives commonly used in hydraulic fluids may also be incorporated into the compositions of this invention. The combination of additives of this invention, while primarily used in hydraulic fluids, may be used in other functional fluids such as heat transfer fluids, coolants, antifreeze fluids, and glycol ether solvents.

Any suitable method may be used in preparing the compositions of the present invention. The components may be added separately or together in any sequence. All components are to be admixed into a homogeneous single phase composition.

SPECIFIC EMBODIMENTS OF THE INVENTION

The following example is given to illustrate the invention and should not be construed as limiting its scope. All parts and percentages are by weight unless otherwise indicated.

PREPARATION OF FLUIDS

A stock fluid with a glycol and alkyl glycol ether base is prepared having the following formula: 75 to 90 percent by volume glycol and alkyl glycol ether diluent; 10 to 25 percent by volume polyglycol lubricant; 0.01 to 1.0 percent by weight corrosion inhibitors; and 0.01 to 1.0 percent by weight oxidation inhibitors. Twelve ounce bottles manufactured from 31 grams of polyethylene are substantially filled with the fluid to be tested. A cap with a foil lining is placed on the bottle to finger tightness and the bottles are heat sealed by means common to packaging such as microwaves.

TESTING PROCEDURE

Sealed bottles containing the fluid to be tested are placed in a scientific oven at a temperature of 43.3° C. for a period of at least 13 weeks. This is designed as an accelerated aging test for the shelf life of the fluid. Results of the evaluation are indicated by the proportion of bottles that maintain their shape in the time period tested. The higher the proportion, the better the results.

EXAMPLE

A fluid is prepared from the stock fluid described above except that from about 0.001 to 1.0 percent by weight sodium borohydride and from about 0.001 to 1.0 percent by weight 2,6-di-tert-butyl-para-hydroxytoluene are added. When evaluated in accordance with the Testing Procedure described above, the fluid containing both sodium borohydride and 2,6-di-tert-butyl-para-hydroxytoluene advantageously exhibits enhanced stabilizing effect as compared to the stock fluid.

What is claimed is:

1. In a composition having from about 50 to 90 percent by volume of one or more diluents of the formula:

$$R^2[O\text{-}R]_yOR^3$$

and R is a diradical alkylene group of from 2 to 4 carbons, $R^2$ is hydrogen or an alkyl group of from 1 to 6 carbon atoms, $R^3$ is hydrogen or an alkyl group of from 1 to 6 carbons, and y is an integer of from 1 to 6, from about 5 to 50 percent by volume of one or more polyoxyalkylene glycol lubricants, from about 0.1 to 5.0 percent by weight of one or more inhibitors, the improvement comprising:

(A) 0.001 to 1.0 percent by weight of one or more butylated hydroxytoluenes, and (B) 0.001 to 1.0 percent by weight of one or more metal borohydrides.

2. The composition of claim 1 wherein the composition comprises from about about 0.01 to 0.1 percent by weight of one or more butylated hydroxytoluenes.

3. The composition of claim 1 wherein the composition comprises from about 0.01 to 1.0 percent by weight of the one or more metal borohydrides.

4. The composition of claim 1 wherein the butylated hydroxytoluene is a dibutylated hydroxytoluene.

5. The composition of claim 1 wherein the butylated hydroxytoluene is a di-tert-butyl hydroxytoluene.

6. The composition of claim 1 wherein the butylated hydroxytoluene is 2,6-di-tert-butyl-para-hydroxytoluene.

7. The composition of claim 1 wherein the metal borohydride is a alkali metal borohydride.

8. The composition of claim 1 wherein the metal borohydride is sodium borohydride.

9. The composition of claim 1 wherein the butylated hydroxytoluene is 2,6-di-tert-butyl-para-hydroxytoluene in an amount of from about 0.01 to 1.0 percent by weight and the metal borohydride is sodium borohydride in an amount of from about 0.001 to 0.1 percent by weight.

10. In a composition having one or more glycol-based diluents of the formula:

$$R^2[O\text{-}R]_yOR^3$$

and R is a diradical alkylene group of from 2 to 4 carbons, $R^2$ is hydrogen or an alkyl group of from 1 to 6 carbon atoms, $R^3$ is hydrogen or an alkyl group of from 1 to 6 carbons, and y is an integer of from 1 to 6, one or more polyoxyalkylene glycol lubricants, and one or more inhibitors, the improvement comprising:

(A) 0.001 to 1.0 percent by weight of one or more butylated hydroxytoluenes, and (B) 0.001 to 1.0 percent by weight of one or more metal borohydrides.

11. The composition of claim 10 wherein the composition comprises from about about 0.01 to 0.1 percent by weight of one or more butylated hydroxytoluenes.

12. The composition of claim 10 wherein the composition comprises from about 0.01 to 1.0 percent by weight of the one or more metal borohydrides.

13. The composition of claim 10 wherein the butylated hydroxytoluene is a dibutylated hydroxytoluene.

14. The composition of claim 10 wherein the butylated hydroxytoluene is a di-tert-butyl hydroxytoluene.

15. The composition of claim 10 wherein the butylated hydroxytoluene is 2,6-di-tert-butyl-para-hydroxytoluene.

16. The composition of claim 10 wherein the metal borohydride is a alkali metal borohydride.

17. The composition of claim 10 wherein the metal borohydride is sodium borohydride.

18. The composition of claim 10 wherein the butylated hydroxytoluene is 2,6-di-tert-butyl-para-hydroxytoluene in an amount of from about 0.01 to 1.0 percent by weight and the metal borohydride is sodium borohydride in an amount of from about 0.001 to 0.1 percent by weight.

19. The composition of claim 1 wherein the one or more diluents are selected from the group consisting of: ethylene glycol monomethyl ether, diethylene glycol monomethyl ether, triethylene glycol monomethyl ether, propylene glycol monomethyl ether, dipropylene glycol monomethyl ether, tripropylene glycol monomethyl ether, diethylene glycol monobutyl ether, triethylene glycol monobutyl ether, tetraethylene glycol monobutyl ether, tetrapropylene glycol monobutyl ether.

20. The composition of claim 1 wherein the one or more diluents are selected from the group consisting of triethylene glycol n-butyl ether and diethylene glycol methyl ether.

21. The composition of claim 10 wherein the one or more diluents are selected from the group consisting of: ethylene glycol monomethyl ether, diethylene glycol monomethyl ether, triethylene glycol monomethyl ether, propylene glycol monomethyl ether, dipropylene glycol monomethyl ether, tripropylene glycol monomethyl ether, diethylene glycol monobutyl ether, triethylene glycol monobutyl ether, tetraethylene glycol monobutyl ether, tetrapropylene glycol monobutyl ether.

22. The composition of claim 10 wherein the one or more diluents are selected from the group consisting of triethylene glycol n-butyl ether and diethylene glycol methyl ether.

* * * * *